US010260777B2

(12) United States Patent
Ward et al.

(10) Patent No.: US 10,260,777 B2
(45) Date of Patent: Apr. 16, 2019

(54) GAS FUELED WATER HEATER APPLIANCE HAVING A TEMPERATURE CONTROL SWITCH

(71) Applicant: Haier US Appliance Solutions, Inc., Wilmington, DE (US)

(72) Inventors: Shaun Michael Ward, Louisville, KY (US); Jonathan D. Nelson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/677,079

(22) Filed: Aug. 15, 2017

(65) Prior Publication Data

US 2019/0056145 A1 Feb. 21, 2019

(51) Int. Cl.

| | |
|---|---|
| ***F24H 9/20*** | (2006.01) |
| ***F24H 1/18*** | (2006.01) |
| *F24H 1/20* | (2006.01) |

(52) U.S. Cl.

CPC ..... *F24H 9/2035* (2013.01); *F24H 1/186* (2013.01); *F24H 1/206* (2013.01); *F24H 9/2007* (2013.01)

(58) Field of Classification Search

CPC ..... F24H 9/2035; F24H 9/2007; F24H 1/186; F24H 1/206

USPC ..... 122/14.21, 18.3, 18.31

See application file for complete search history.

(56) References Cited

U.S. PATENT DOCUMENTS

| | | | | |
|---|---|---|---|---|
| 6,484,358 | B1 * | 11/2002 | Duong | F16L 5/02 16/2.1 |
| 6,964,248 | B2 | 11/2005 | Stretch et al. | |
| 7,051,683 | B1 * | 5/2006 | Lee | F23N 5/123 122/14.21 |
| 7,451,725 | B2 * | 11/2008 | Garrabrant | F23N 5/042 122/14.21 |
| 9,228,746 | B2 | 1/2016 | Hughes et al. | |
| 2010/0136392 | A1 * | 6/2010 | Pulliam | G01K 1/026 429/90 |
| 2010/0176912 | A1 * | 7/2010 | Sears | G01K 1/14 338/22 R |

* cited by examiner

*Primary Examiner* — Steven B McAllister
*Assistant Examiner* — Benjamin W Johnson
(74) *Attorney, Agent, or Firm* — Dority & Manning, P.A.

(57) ABSTRACT

A gas fueled water heater appliance having a temperature control switch is provided herein. The gas fueled water heater appliance may include a tank for storage of water for heating, a chamber wall, a gas burner, a valve, the temperature control switch, and a conductive probe. The chamber wall may define a combustion chamber. The gas burner may be positioned adjacent to the tank and within the combustion chamber to heat the water in the tank. The valve may control a flow of gaseous fuel to the gas burner. The temperature control switch may be in operable communication with the valve. The conductive probe may extend through the chamber wall from a first end positioned on the temperature control switch to a second end positioned within the combustion chamber.

19 Claims, 11 Drawing Sheets

GAS FUELED WATER HEATER APPLIANCE HAVING A TEMPERATURE CONTROL SWITCH

FIELD OF THE INVENTION

The present subject matter relates generally to gas fueled water heater appliances, and more particularly to gas fueled water heater appliances having features for temperature monitoring and gas flow control.

BACKGROUND OF THE INVENTION

A variety of energy sources are used in creating hot water for commercial and residential use including electric, solar, and various fuels. Natural gas and propane are preferred by some customers due to, for example, the relatively quick heating rate. These fuels are supplied as a gas that is burned in a combustion chamber to provide heat energy to raise the water temperature.

Temperatures in the combustion chamber are relatively high and can, for example, reach 600 degrees Fahrenheit or higher during normal operation. A flame is created by burning a mixture of the gaseous fuel and air. Proper combustion requires that the air and fuel are provided within a particular ratio to ensure, for example, complete combustion and avoid wasted fuel or the production of unwanted by-products such as carbon monoxide.

In certain conditions, such as if a water heater appliance is installed in a dusty area containing above average levels of, for example, dirt, oil, or lint, the air intake of water heater can become clogged. The lack of sufficient air can cause the temperature of the combustion chamber to become too hot. As another example, a flammable vapor event such as the ignition of vapor from liquid fuel present near the water heater can also create elevated temperatures in the water heater combustion chamber.

Accordingly, it is desirable to monitor temperature and terminate the combustion process by, for example, shutting off the gas flow if the temperature reaches unsafe levels. However, challenges exist with conventional approaches to monitoring temperature at a combustion chamber for a water heater appliance.

One conventional approach is the use of a temperature-dependent switch placed in direct contact with an outer surface of the wall of the combustion chamber. Once the outer surface of the wall sufficiently heats the switch to a predetermined maximum temperature, the switch is activated so as to cause a control system to close off the flow of gas. However, because the switch must be placed in contact with the combustion chamber wall, it does not provide a direct measurement of the temperature of the combustion process. Instead, heat must be transmitted to the wall of the combustion chamber before the switch can be triggered due to an unsafe condition. In some configurations or conditions, the switch may be undesirably influenced by ambient temperatures. For instance, relatively low ambient temperatures may increase the amount of heat drawn from the wall of the combustion heater (e.g., before that heat can be conducted to the switch). The increased heat drawn from the wall may hinder or prevent the switch from detecting an unsuitably high temperature within the combustion chamber. In turn, it may be difficult to ensure proper operation of the switch across a wide range of ambient temperatures and conditions.

Other approaches may require a temperature sensor to be mounted on or within the combustion chamber. A control board connected to the temperature sensor may receive signals from the temperature sensor and halt operation of the water heater appliance or burner based on those same signals. However, such approaches may increase the difficulty of assembling and/or installing the water heater appliance. Moreover, such approaches may be unreliable or susceptible to damage (e.g., at the control board).

Accordingly, a water heater appliance including features to address one or more of the above issues would be desirable. In particular, it would be advantageous to have a gas fueled water heater appliance including an improved system for monitoring the temperature of the combustion chamber of the gas fueled water heater appliance.

BRIEF DESCRIPTION OF THE INVENTION

Aspects and advantages of the invention will be set forth in part in the following description, or may be obvious from the description, or may be learned through practice of the invention.

In one aspect of the present disclosure, a gas fueled water heater appliance is provided. The gas fueled water heater appliance may include a tank for storage of water for heating, a chamber wall, a gas burner, a valve, a temperature control switch, and a conductive probe. The chamber wall may define a combustion chamber. The gas burner may be positioned adjacent to the tank and within the combustion chamber to heat the water in the tank. The valve may control a flow of gaseous fuel to the gas burner. The temperature control switch may be in operable communication with the valve. The conductive probe may extend through the chamber wall from a first end positioned on the temperature control switch to a second end positioned within the combustion chamber.

In another aspect of the present disclosure, a gas fueled water heater appliance is provided. The gas fueled water heater appliance may include a tank for storage of water for heating, a chamber wall, a gas burner, a valve, a temperature control switch, and a conductive probe. The combustion wall may define a combustion chamber. The chamber wall may include an inner surface directed toward the combustion chamber and an outer surface directed away from the combustion chamber. The gas burner may be positioned adjacent to the tank and within the combustion chamber to heat the water in the tank. The valve may control a flow of gaseous fuel to the gas burner. The temperature control switch may be in operable communication with the valve. The temperature control switch may be spaced apart from the outer surface of the chamber wall. The conductive probe may extend through the chamber wall from a first end to a second end. The first end may be positioned proximal to the outer surface on the temperature control switch. The second end may be positioned proximal to the inner surface within the combustion chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
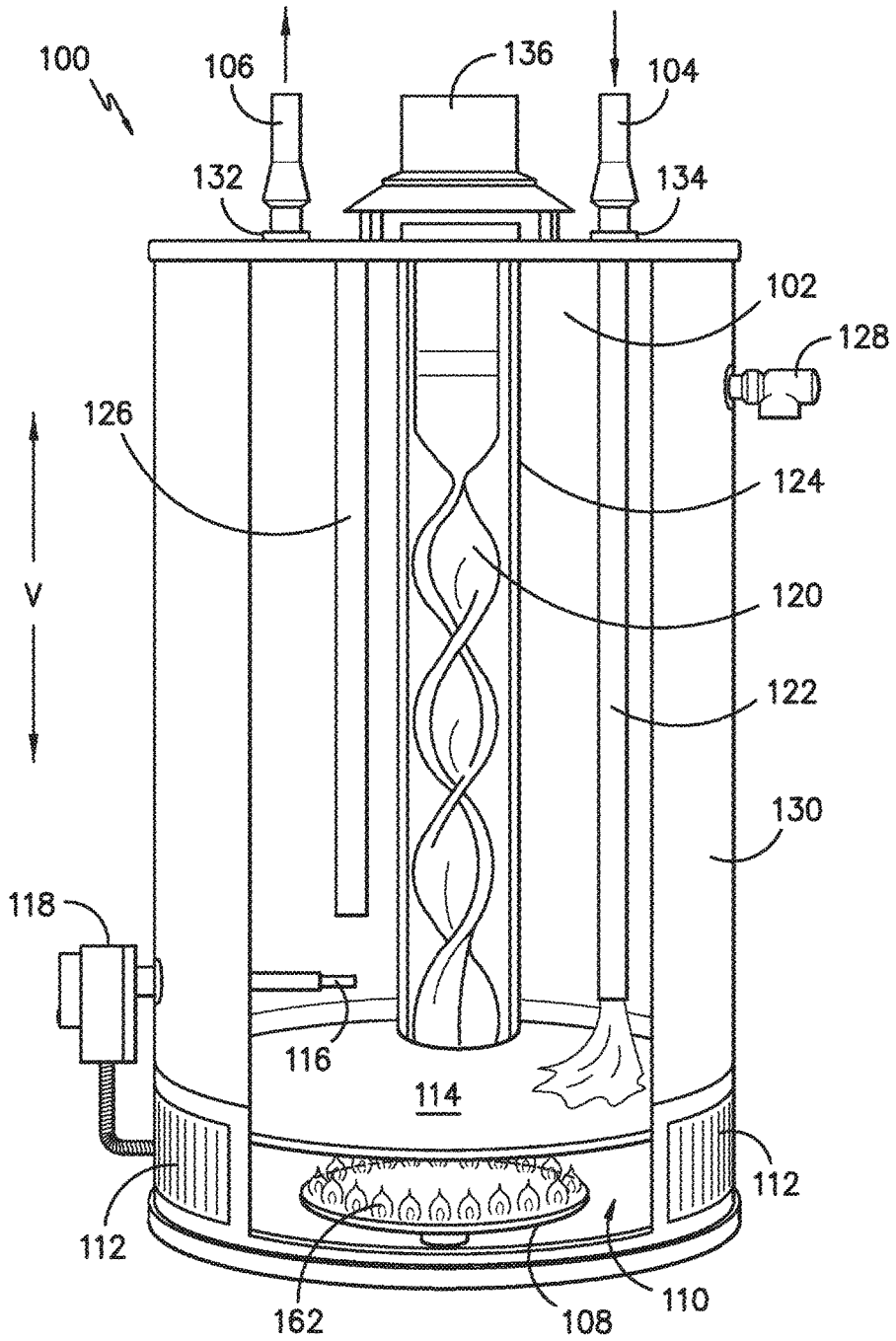
FIG. 1 provides a partially cut away, side view of a water heater appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates a partial sectional, side view of an exemplary water heater 100 of the present invention. Water heater 100 includes a tank 102 where water is stored and heated. Water is supplied to tank 102 by inlet line 104. Heated water is supplied by tank 102 through outlet line 106. Water heater 100 is fluidly connected with lines 104 and 106 using connections 132 and 134. In turn, lines 104 and 106 connect with the water supply system of, for example, a residence or a commercial structure.

From line 104, water travels into tank 102 through a cold water dip tube 122 that extends along vertical direction V towards the bottom 114 of tank 102. After being heated, water exits tank 102 by travelling vertically upward and out through outlet line 106. Anode rod 126 provides protection against corrosion attacks on tank 102 and other metal components of water heater 100. A pressure relief valve 128 provides for a release of water from tank 102 in the event the pressure rises above a predetermined amount.

Water heater 100 includes a combustion chamber 110 in which a gas burner 108 is centrally located. During use, gas burner 108 may be supplied with a gaseous fuel (e.g., propane or natural gas). Air travels into combustion chamber 110 through air intake 112 in cabinet 130. The resulting mixture of air and gas is ignited and burned to heat bottom 114 of tank 102 and its water contents. Hot combustion gas 120 exits combustion chamber 110 through a vent or flue 124 centrally located within tank 102. Heat exchange with flue 124 may help heat water in tank 102. A baffle 120 may further promote this heat exchange. Gas 120 exits water heater 100 though vent hood 136, which may be connected with additional vent piping (not shown).

A thermostat 116 measures the temperature of water in tank 102 and provides a signal to gas control valve module 118. As used herein, "a signal" is not limited to a single measurement of temperature and, instead, may include multiple measurements over time or continuous measurements over time. The signal may be provided through, for example, changes in current, voltage, resistance, or others. Depending upon whether the desired temperature has been reached as determined (e.g., from the signal from thermostat 116), gas control valve module 118 regulates the flow of gas to burner 108.

Figure 2:
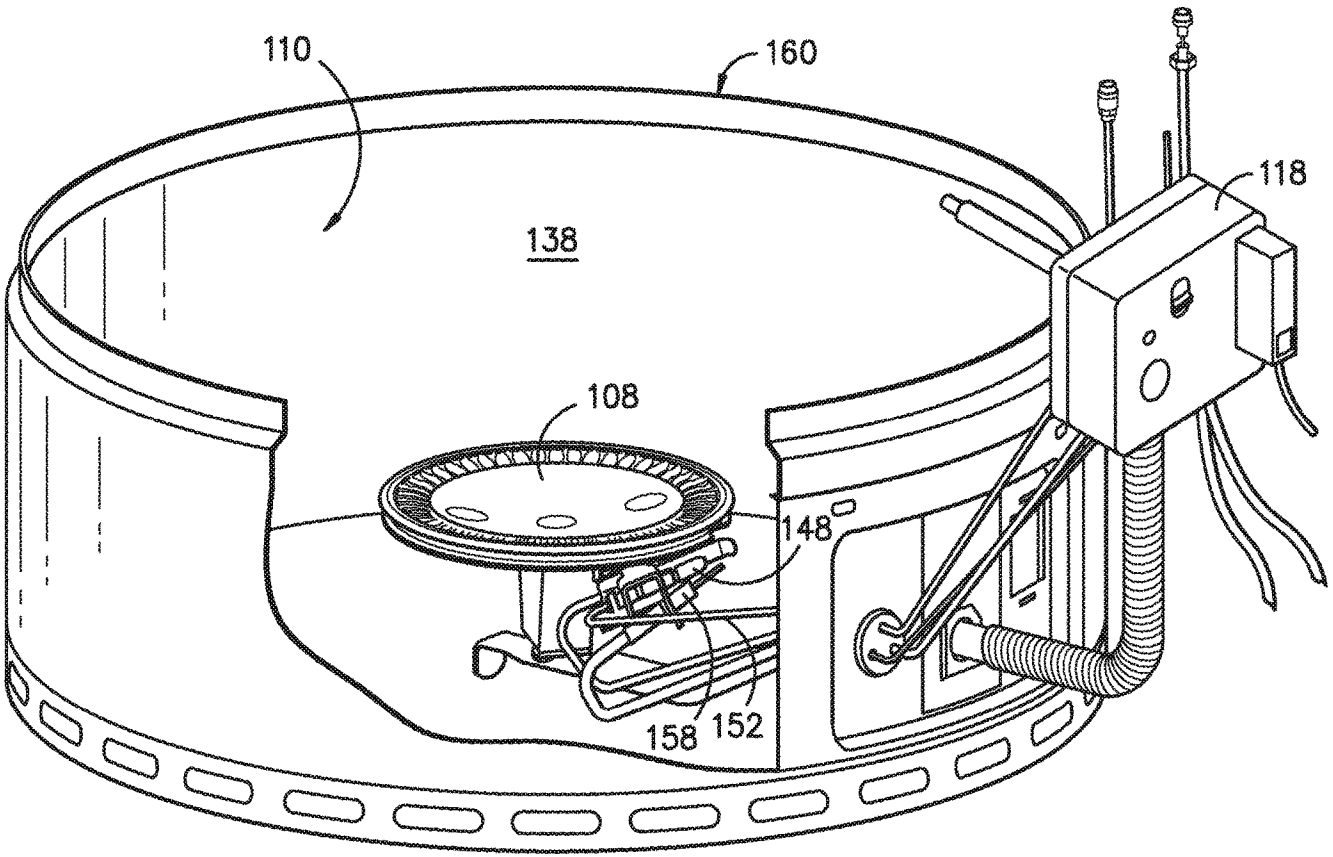
FIG. 2 provides a perspective view of an exemplary gas combustion chamber as may be used with the exemplary water heater appliance of FIG. 1.

Referring now to FIG. 2, combustion chamber 110 is formed by a chamber wall 138 that at least partially encloses combustion chamber 110 and may also provide support for tank 102 along top edge 160. As shown, chamber wall 138 encircles burner 108 and is spaced apart (e.g., radially) from burner 108. Chamber wall 138 may be part of cabinet 130 (FIG. 1) or may be a separate component.

Figure 3:
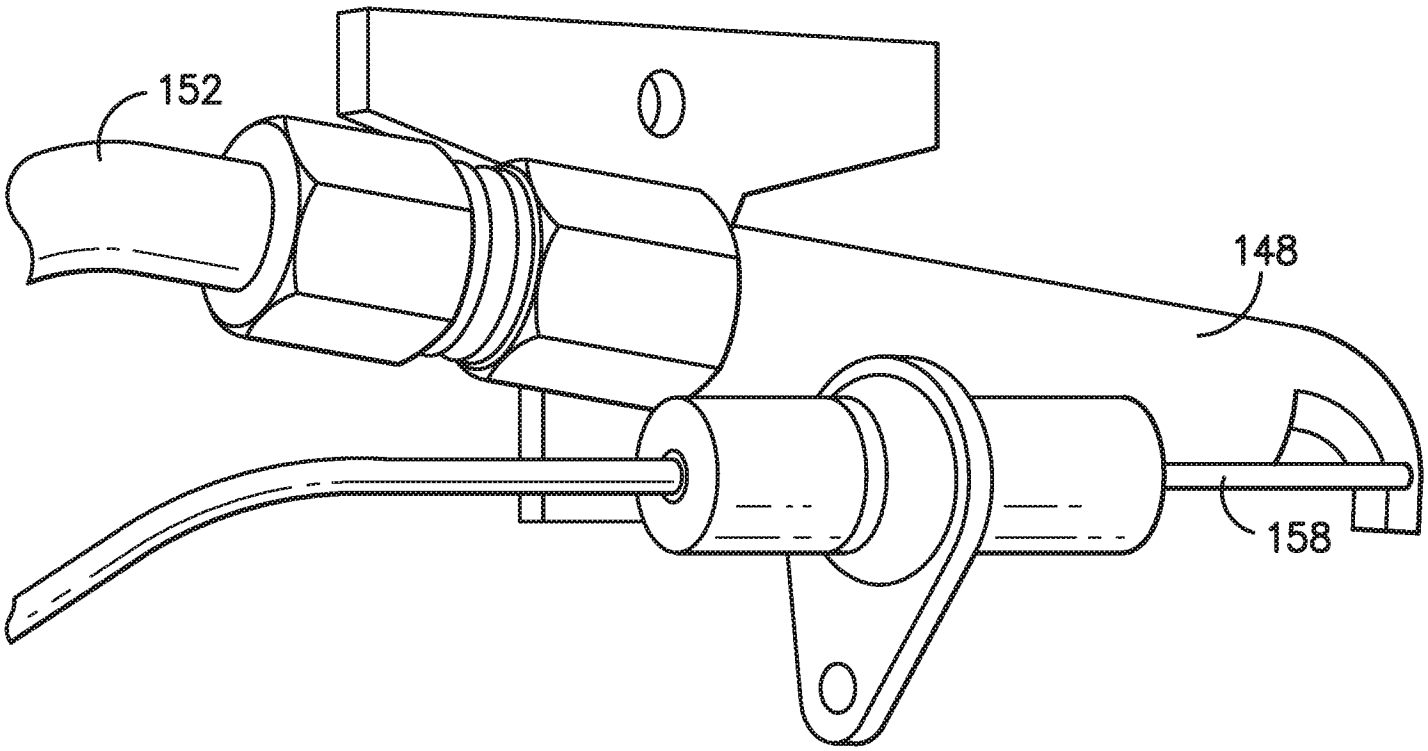
FIG. 3 provides a close-up view of certain exemplary components positioned adjacent to burner of the exemplary water heater appliance of FIGS. 1 and 2.
Figure 4:
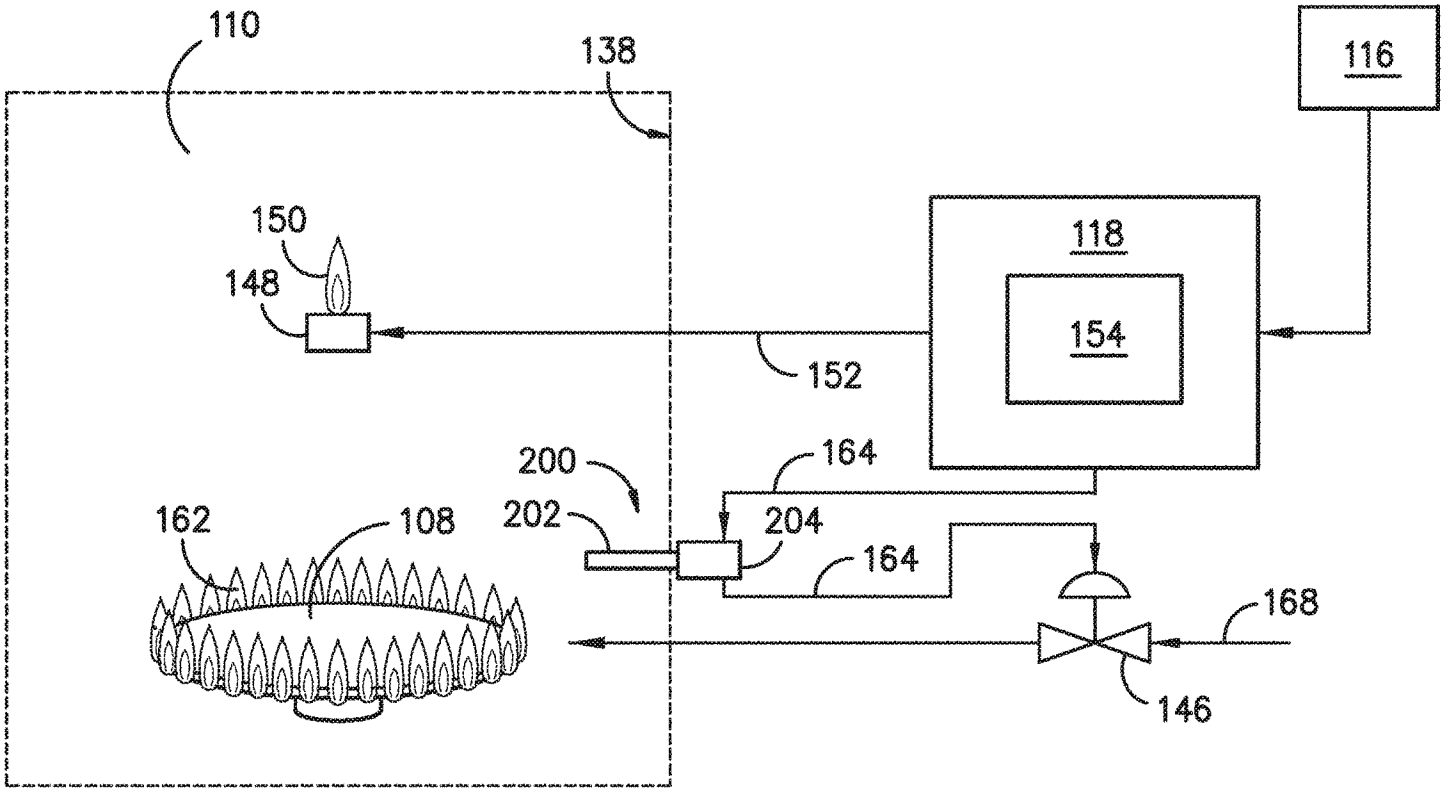
FIG. 4 provides a schematic of a gas flow control system as may be used with the exemplary water heater of FIG. 1.

FIG. 3 provides a close-up view of certain components positioned beneath and adjacent to gas burner 108. FIG. 4 provides a schematic representation of combustion chamber 110 and certain other components as will be further described. As shown, water heater 100 includes a pilot burner 148 that provides a pilot light 150 (FIG. 4) to ignite a mixture of air and fuel at burner 108 when a gas valve 146 is open. An igniter 158 is positioned adjacent to pilot burner 148 and generates a spark used to ignite gaseous fuel and provide pilot light 150. Gaseous fuel for pilot burner 108 is supplied by pilot burner fuel line 152. Gas valve control module 118 with controller 154 controls the flow of gaseous fuel through pilot burner fuel line 152 and the flow of gas to burner 108 from gaseous fuel supply 168.

Gas valve control module 118 includes at least one controller 154. By way of example, controller 154 may include memory (e.g., non-transitive storage media) and one or more processing devices such as microprocessors, CPUs or the like, such as general or special purpose microprocessors operable to execute programming instructions or micro-control code associated with operation of water heater 100 as further described herein. The memory can represent random access memory such as DRAM, or read only memory such as ROM or FLASH. The processor executes programming instructions stored in the memory. The memory can be a separate component from the processor or can be included onboard within the processor. Alternatively, controller 154 may be constructed without using a microprocessor, for example, using a combination of discrete analog and/or digital logic circuitry (such as switches, amplifiers, integrators, comparators, flip-flops, AND gates, and the like) to perform control functionality instead of relying upon software.

As stated above, water heater 100 includes a gas valve 146 positioned along main gas supply line 168. Controller 154 is in operable communication (e.g., electrically connected, wirelessly connected, etc.) with gas valve 146 to generally control the flow of gas therethrough by determining when valve 146 is energized. In some embodiments, gas valve 146 operates so that when energized, valve 146 is fully open to allow a flow of gaseous fuel to burner 108. When not fully energized, valve 146 is fully closed (i.e., a "fail-closed" type valve) so as to prevent the flow of gaseous fuel to burner 108.

As illustrated, a temperature detection assembly 200 is mounted adjacent to burner 108 to detect temperatures within combustion chamber 110. In some such embodiments, a conductive probe 202 extends from a temperature control switch 204 into combustion chamber 110 near a flame 162 generated at burner 108. During certain operations, a portion of heat generated at burner 108 may be conducted through conductive probe 202, outside of combustion chamber 110, and to temperature control switch 204.

When assembled, temperature control switch 204 is provided in operable communication with valve 146. For instance, temperature control switch 204 may be electrically connected (e.g., in series) between valve 146 and controller 154. In turn, one or more conductors 164 may extend between gas valve control module 118 and temperature control switch 204, as well as between temperature control switch 204 and valve 146. Optionally, temperature control switch 204 may be a normally-closed switch. Moreover, temperature control switch 204 may generally be operable to selectively restrict a current or voltage to valve at or above a predetermined temperature. Specifically, temperature control switch 204 may configured for actuating from a first (e.g., closed) state to a second (e.g., open) state based on a temperature detected or reached at temperature control switch 204 (e.g., in reaction to heat conducted through conductive probe 202). In some such embodiments, temperature control switch 204 is provided as a bimetal switch. The bimetal switch may thus actuate or adjust from the first state to the second state when the detected temperature exceeds a threshold temperature. When temperature control switch 204 is closed (e.g., below the threshold temperature), an electrical signal or current may thus pass through temperature control switch 204 between controller 154 and valve 146, permitting energization of valve 146. By contrast, when temperature control switch 204 is open (e.g., above the threshold temperature), the electrical circuit may be broken, restricting or preventing an electrical signal or current therethrough. In turn, energization of valve 146 may be prevented.

Figure 5:
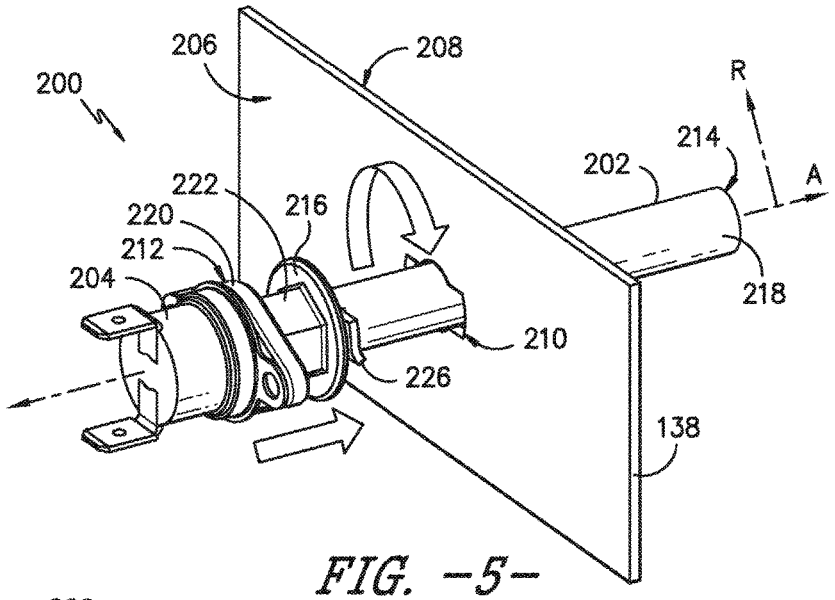
FIG. 5 provides a close-up perspective view of a temperature detection assembly before being mounted on a wall of exemplary embodiments of a water heater appliance.
Figure 6:
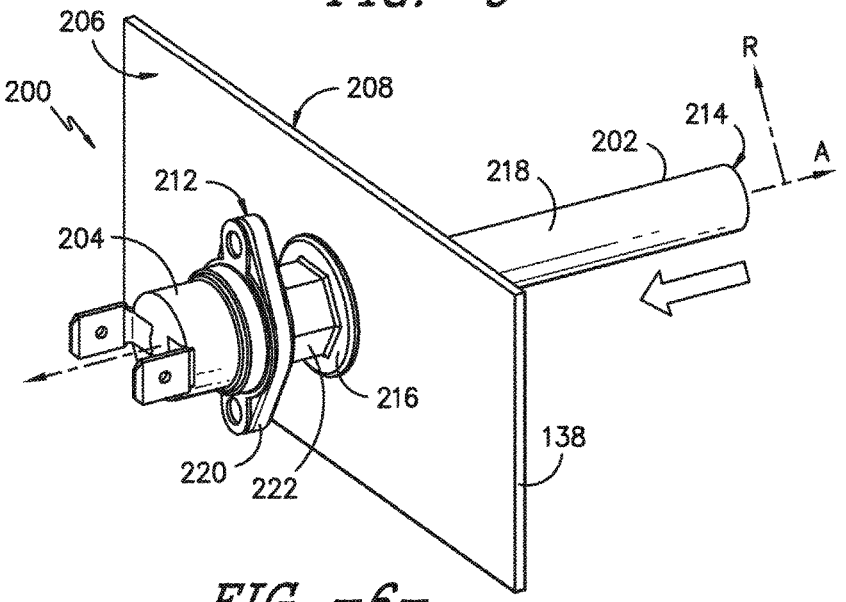
FIG. 6 provides a close-up perspective view of the temperature detection assembly of FIG. 5 after being mounted on the wall of exemplary embodiments of a water heater appliance.

Turning now to FIGS. 5 through 10, various views of an exemplary temperature detection assembly 200 are provided. FIGS. 5 and 6, in particular, provide various close-up perspective views of temperature detection assembly 200 according to exemplary embodiments. As shown, temperature detection assembly 200 may be selectively moved between an unmounted position (FIG. 5) and a mounted position (FIG. 6) on chamber wall 138. In other words, FIG. 5 provides a close-up perspective view of temperature detection assembly 200 before being mounted on chamber wall 138, while FIG. 6 provides a close-up perspective view of temperature detection assembly 200 after being mounted on chamber wall 138.

As shown, chamber wall 138 generally includes an inner surface 208 and an outer surface 206 that are spaced apart along an axial direction A. Inner surface 208 may be directed toward combustion chamber 110 (e.g., proximal to burner 108—FIG. 2), while outer surface 206 is directed away from combustion chamber 110 (e.g., toward the ambient environment and/or distal to burner 108). A wall aperture 210 may be defined through chamber wall 138 from the outer surface 206 to the inner surface 208 (e.g., along the axial direction A), as will be described in detail below.

In some embodiments, at least a portion of temperature detection assembly 200 extends through chamber wall 138. Specifically, the mounted conductive probe 202 may extend from a first end 212 to a second end 214 (e.g., along the axial direction A) and through chamber wall 138. For instance, conductive probe 202 may be received within wall aperture 210 when mounted to chamber wall 138, as shown in FIG. 6. When mounted, the first end 212 of conductive probe 202 may be positioned proximal to the outer surface 206 and distal to the inner surface 208 of chamber wall 138. Moreover, the second end 214 of conductive probe 202 may be positioned proximal to the inner surface 208 and distal to the outer surface 206 of chamber wall 138. In some embodiments, at least a portion of conductive probe 202 including the second end 214 is mounted within combustion chamber 110, while another portion of conductive probe 202 including the first end 212 is held outside of combustion chamber 110.

In the exemplary embodiments of FIGS. 5 and 6, temperature control switch 204 is attached to conductive probe 202. Specifically, the first end 212 of conductive probe 202 is mounted on temperature control switch 204 (e.g., in contact therewith). One or more adhesives or mechanical connectors (e.g., screws, bolts, clamps, etc.) may secure conductive probe 202 to temperature control switch 204. During use, heat from the second end 214 of conductive probe 202 may thus be transmitted to temperature control switch 204 at the first end 212. Optionally, the mounted temperature detection assembly 200 may provide temperature control switch 204 at a fixed distance from chamber wall 138 (e.g., along the axial direction A). In other words, temperature control switch 204 may be spaced apart from the chamber wall 138 (e.g., at the outer surface 206). Conductive probe 202 may define the fixed distance at which temperature control switch 204 is spaced from the outer surface 206 of chamber wall 138. In some such embodiments, a radial flange 216 of conductive probe 202 may engage chamber wall 138 (e.g., at outer surface 206), restricting axial movement of conductive probe 202 toward the combustion chamber 110. In the described position, conductive heat exchange between temperature control switch 204 and chamber wall 138, and thereby the effects of the ambient environment, may be notably limited or restricted. Advantageously, the temperature detected at temperature control switch 204 may accurately reflect the temperature within combustion chamber 110, independent of the ambient conditions surrounding chamber wall 138.

Figure 7:
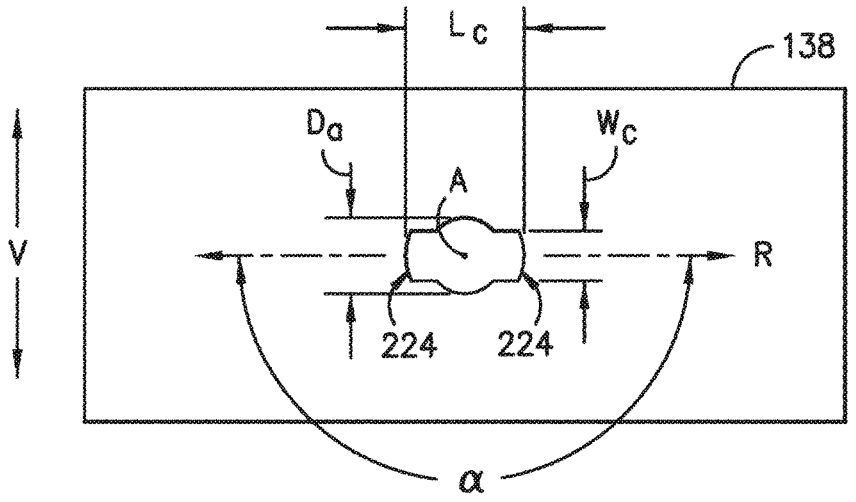
FIG. 7 provides a front view of a portion of the wall of exemplary embodiments of a water heater appliance, as shown in FIG. 6.
Figure 8:
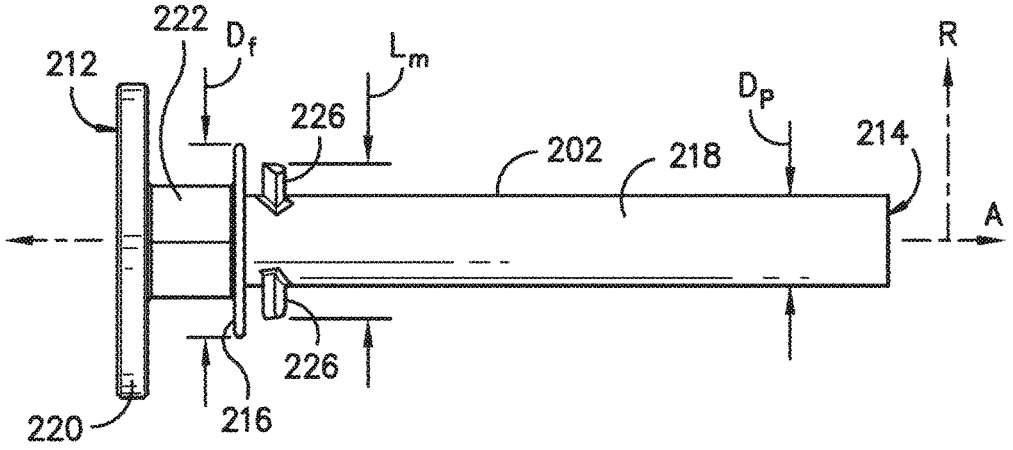
FIG. 8 provides a side view of a portion of the exemplary temperature detection assembly of FIG. 6.

Turning to FIGS. 7 and 8, views are provided of a portion of chamber wall 138 and conductive probe 202, respectively. As illustrated in FIG. 8, some embodiments of conductive probe 202 generally extend along the axial direction A between the first end 212 and the second end 214. Optionally, conductive probe 202 may be formed as an integral member (e.g., from a unitary and monolithic metal material). A probe body 218 may be formed at and/or from the second end 214 with a set (e.g., continuous) probe diameter $D_p$. A planar contact body 220 may be formed at and/or from the first end 212 to engage temperature control switch 204 (FIG. 6). Radial flange 216 may extend outward (e.g., along a radial direction R) from probe body 218 with a flange diameter $D_f$ that is greater than the probe diameter $D_p$. In some such embodiments, radial flange 216 is positioned between the first end 212 and the second end 214 (e.g., between planar contact body 220 and probe body 218 along the axial direction A). Optionally, a collar body 222 is provided between radial flange 216 and planar contact body 220.

Turning especially to FIG. 7, the wall aperture 210 defined through chamber wall 138 may include multiple discrete lengths for a single continuous void (e.g., perpendicular to the axial direction A). For instance, an aperture diameter $D_a$ may be included as a first maximum length of the wall aperture 210 (e.g., maximum length in a vertical direction V). In optional embodiments, one or more flared channels 224 may extend radially outward from the aperture diameter $D_a$ as a continuous portion of wall aperture 210. A flared channel length $L_c$ outward from aperture diameter $D_a$ may thus define a second maximum length that is greater than the first maximum length. Moreover, the flared channel length $L_c$ may be defined at an angle (e.g., 90°) offset from the first maximum length about the axial direction A. A flared channel width $W_c$ that is less than the aperture diameter $D_a$ may be defined from the flared channel length $L_c$ (e.g., at a point that is radially spaced from the axial direction A). As shown, the aperture diameter $D_a$ may thus be smaller than flared channel length $L_c$, while being larger than the flared channel width $W_c$. In additional or alternative embodiments, two discrete flared channels 224 are spaced apart about the axial direction A at a predetermined angle $\alpha$. For example, the predetermined angle $\alpha$ may be 180° such that the flared channel length $L_c$ extends from the radial maxima of one flared channel 224 to the radial maxima of the other flared channel 224.

In some embodiments, probe diameter $D_p$ (FIG. 8) is less than aperture diameter $D_a$, such that probe body 218 (FIG. 8) may be readily received within wall aperture 210 between the first end 212 and the second end 214 of conductive probe 202 (FIG. 8). In further embodiments, probe diameter $D_p$ is greater than flared channel width $W_c$, such that probe body 218 may be prevented from passing into or through flared channel 224 (e.g., during assembly). In additional or alternative embodiments, flange diameter $D_f$ is greater than aperture diameter $D_a$ and/or flared channel length $L_c$, thereby restricting radial flange 216 (FIG. 8) from passing into or through wall aperture 210.

Figure 9:
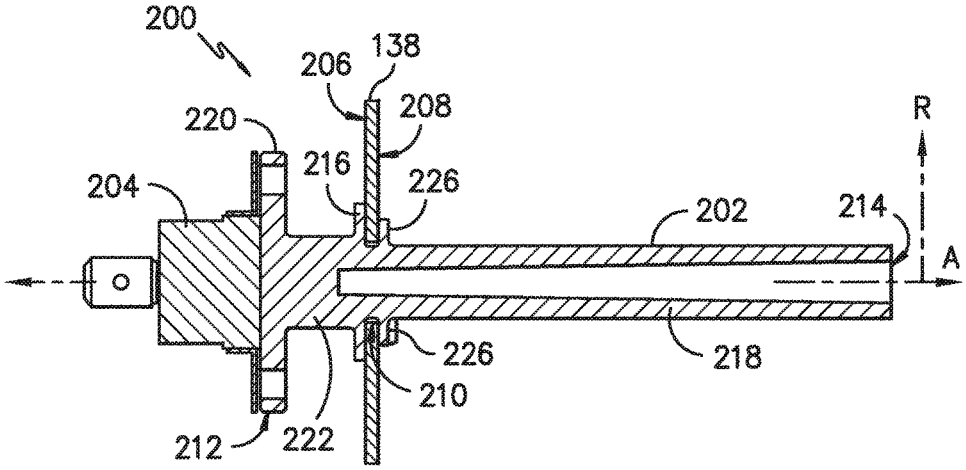
FIG. 9 provides a close-up, cross-sectional top view of the mounted temperature detection assembly and wall of FIG. 6.
Figure 10:
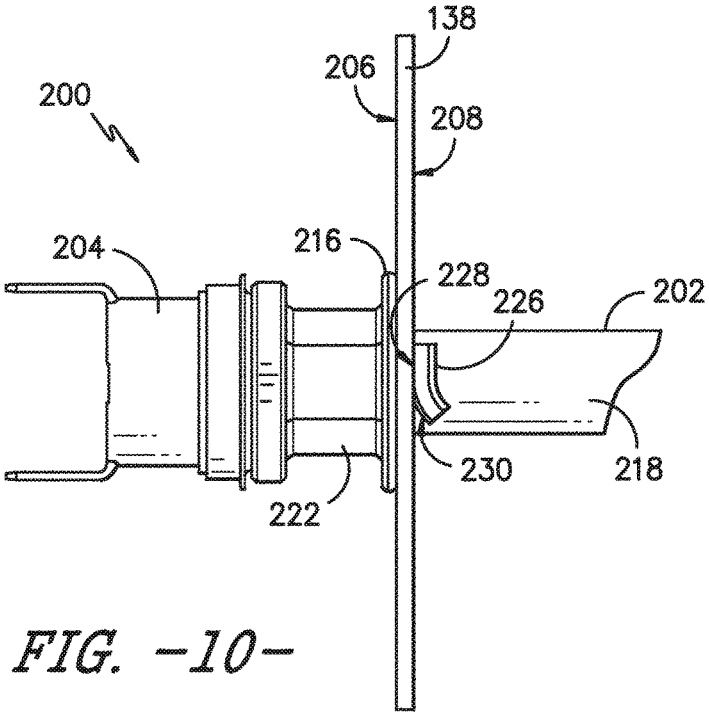
FIG. 10 provides a close-up, partial side view of the mounted temperature detection assembly and wall of FIG. 6.
Figure 11:
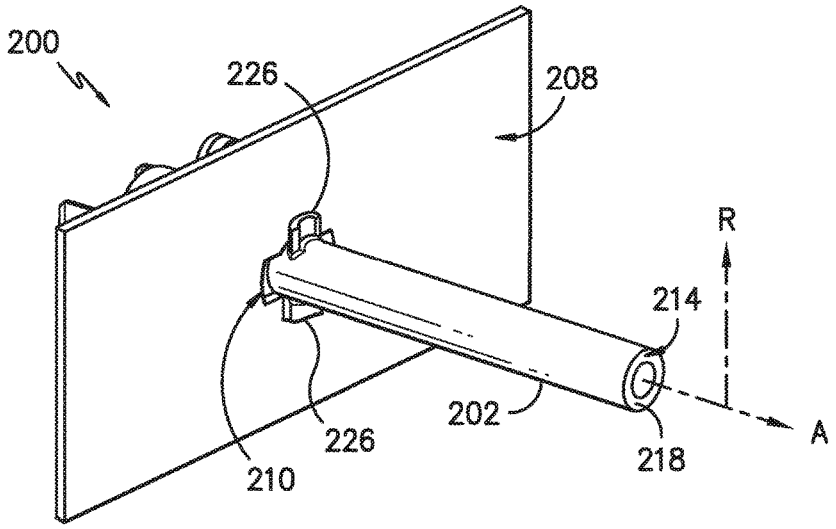
FIG. 11 provides a close-up, interior perspective view of the mounted temperature detection assembly and wall of FIG. 6.

Turning now to FIGS. 9 through 11, various views of the mounted temperature detection assembly 200, as illustrated in FIG. 6, are provided. In some embodiments, conductive probe 202 includes plurality of radial tabs 226. For instance, a pair of radial tabs 226 may extend outward from probe body 218 in the radial direction R. The radial tabs 226 are generally matched to correspond to the flared channels 224 (FIG. 7). In turn, each of the radial tabs 226 may be sized to slide or pass through a corresponding flared channel 224 along the axial direction A. For example, the radial tabs 226 may be angularly spaced or offset at the predetermined angle $\alpha$ (FIG. 7). The combined length $L_m$ defined by the radial tabs 226 and probe body 218 may be less than the flared channel length $L_c$ (FIG. 7). Moreover the combined length $L_m$ may be greater than the aperture diameter $D_a$ (FIG. 7).

In certain embodiments, each radial tab 226 defines a support surface 228 and an angled leading surface 230 extending continuously from support surface 228. As shown, when conductive probe 202 is mounted to chamber wall 138, both support surface 228 and angled leading surface 230 may be generally directed toward or face inner surface 208 of chamber wall 138. For instance, both support surface 228 and angled leading surface 230 extend along the radial direction R from probe body 218. In some such embodiments, support surface 228 may extend orthogonally to the axial direction A (e.g., along a plane orthogonal to the axial direction A). Leading surface 230 may extend arcuately or at a non-orthogonal angle from support surface 228 toward the second end 214 of conductive probe 202. In other words, an arcuate angle may be defined between leading surface 230 and a plane along which support surface 228 is defined. Support surface 228 may engage (e.g., contact) inner surface 208 when mounted, while leading surface 230 is spaced apart from the inner surface 208 (e.g., along the axial direction A). In specific embodiments, support surface 228 contacts inner surface 208 in an interference fit such that chamber wall 138 is held between radial flange 216 and support surface 228. In turn, axial movement of the conductive probe 202 may be restricted in the mounted position.

Thus, as illustrated by FIGS. 5 and 6, temperature detection assembly 200 may be rotated about the axial direction A such that radial tabs 226 and flared channels 224 are mutually aligned about axial direction A. While tabs 226 and channels 224 are mutually aligned, temperature detection assembly 200 may be moved along the axial direction A such that radial tabs 226 are positioned within the combustion chamber 110. Specifically, temperature detection assembly 200 may move along the axial direction toward combustion chamber 110 until radial flange 216 engages (e.g., contacts) the outer surface 206 of chamber wall 138. Subsequently, conductive probe 202 may be rotated about the axial direction A. As conductive probe 202 is rotated, leading surface 230 may slide along the inner surface 208 of chamber wall 138, further motivating conductive probe 202 along the axial direction A, until support surface 228 is brought into contact with inner surface 208. Radial tabs 226 may thus hold temperature detection assembly 200 against chamber wall 138 in a mounted position.

Figure 12:
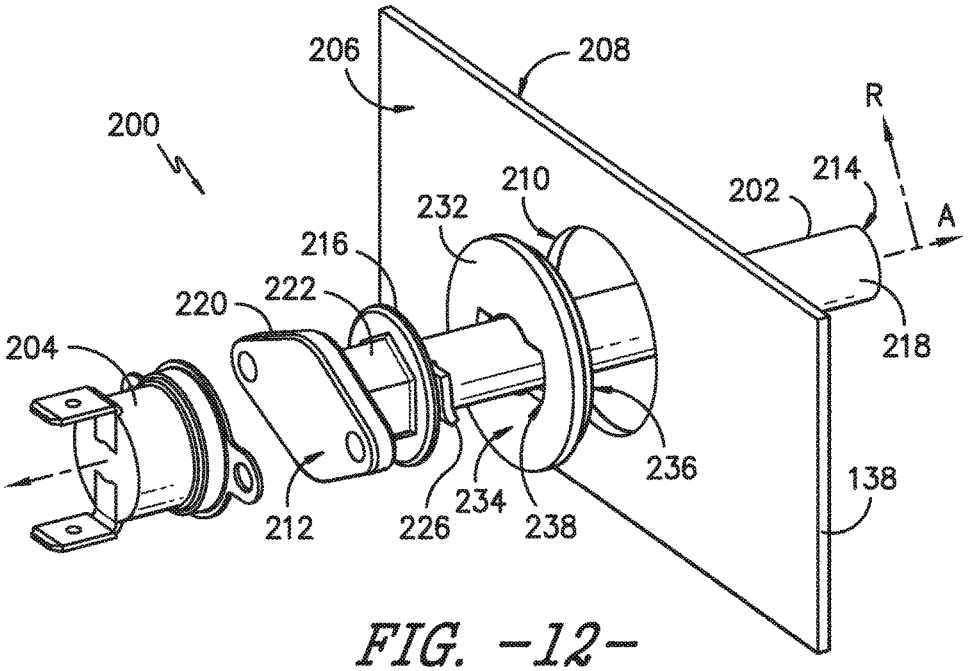
FIG. 12 provides a close-up, exploded perspective view of a temperature detection assembly and wall of alternative exemplary embodiments of a water heater appliance.
Figure 13:
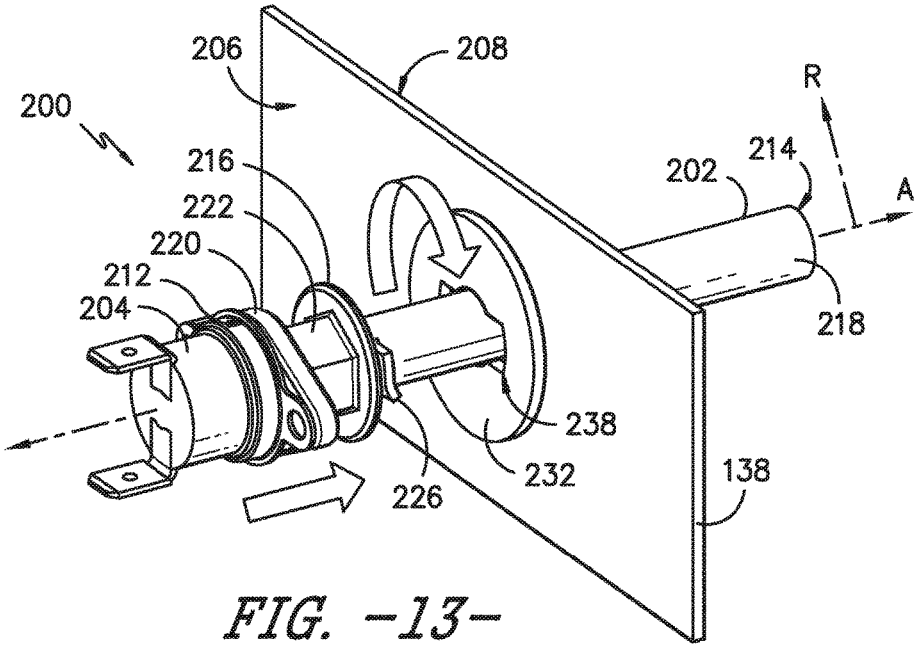
FIG. 13 provides a close-up perspective view of the temperature detection assembly of FIG. 12 before being mounted on the wall of exemplary embodiments of a water heater appliance.
Figure 14:
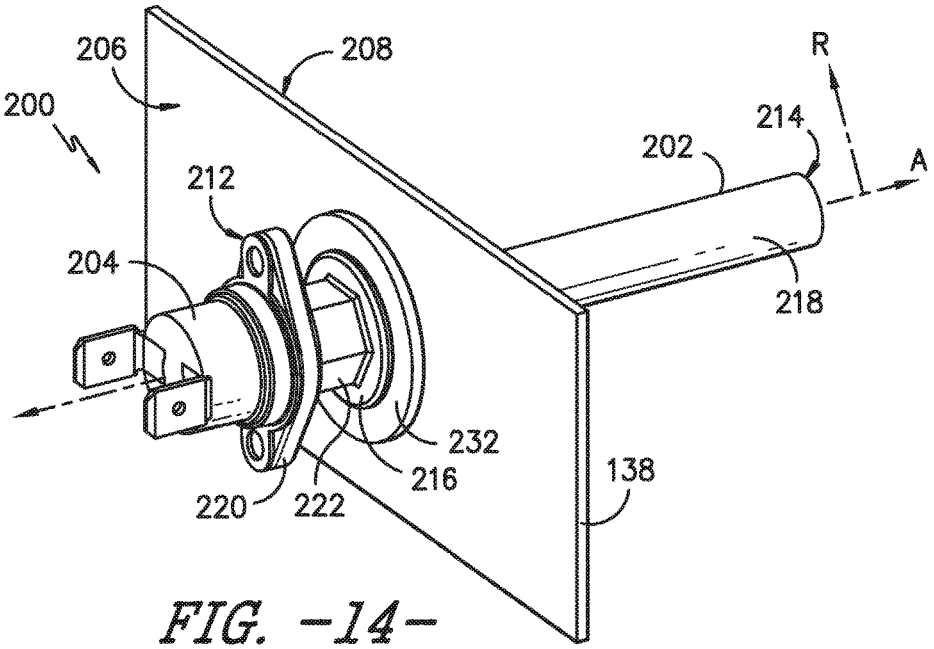
FIG. 14 provides a close-up perspective view of the temperature detection assembly of FIG. 13 after being mounted on the wall of exemplary embodiments of a water heater appliance.

Turning now to FIGS. 12 through 17, various views of another exemplary temperature detection assembly 200 are provided. FIGS. 12 through 14, in particular, provide various close-up perspective views of temperature detection assembly 200 according to exemplary embodiments. It is understood that, except as otherwise indicated, the exemplary embodiments of FIGS. 12 through 17 may be similar to those embodiments described above, with respect to FIGS. 1 through 11. For instance, as described above, the exemplary embodiments of FIGS. 12 through 17 may provide a temperature detection assembly 200 that is selectively movable between mounted and unmounted positions relative to chamber wall 138. However, unlike the above-described embodiments of FIGS. 5 through 11, the embodiments of FIGS. 12 through 17 include an insulating grommet 232, as will be described in detail below.

As shown, in FIGS. 12 through 14, temperature detection assembly 200 may be selectively moved between an unmounted position (FIG. 13) and a mounted position (FIG. 14) on chamber wall 138. In other words, FIG. 13 provides a close-up perspective view of temperature detection assembly 200 before being mounted on chamber wall 138, while FIG. 14 provides a close-up perspective view of temperature detection assembly 200 after being mounted on chamber wall 138. FIG. 12 provides a close-up, exploded perspective view of temperature detection assembly 200 and chamber wall 138.

As shown, chamber wall 138 generally includes an inner surface 208 and an outer surface 206 that are spaced apart along an axial direction A. Inner surface 208 may be directed toward combustion chamber 110 (e.g., proximal to burner 108—FIG. 2), while outer surface 206 is directed away from combustion chamber 110 (e.g., toward the ambient environment and/or distal to burner 108). A wall aperture 210 may be defined through chamber wall 138 from the outer surface 206 to the inner surface 208 (e.g., along the axial direction A) to receive an insulating grommet 232.

Generally, insulating grommet 232 may be formed from an insulating rubber or plastic material. Moreover, insulating grommet 232 may include an inner face 236 directed toward the combustion chamber 110 (e.g., proximal to burner 108—FIG. 2) and an outer face 234 directed away from the combustion chamber 110 (e.g., toward the ambient environment and/or distal to burner 108). Insulating grommet 232 may further define a grommet passage 238 from the outer face 234 to the inner face 236 (e.g., along the axial direction A), as will be described in detail below.

In some embodiments, at least a portion of temperature detection assembly 200 extends through chamber wall 138. Specifically, the mounted conductive probe 202 may extend from a first end 212 to a second end 214 (e.g., along the axial direction A) and through chamber wall 138. For instance, conductive probe 202 may be received within wall aperture 210 and grommet passage 238 when mounted to chamber wall 138, as shown in FIG. 14. When mounted, the first end 212 of conductive probe 202 may be positioned proximal to the outer surface 206 and distal to the inner surface 208 of chamber wall 138. Moreover, the second end 214 of conductive probe 202 may be positioned proximal to the inner surface 208 and distal to the outer surface 206 of chamber wall 138. In some embodiments, at least a portion of conductive probe 202 including the second end 214 is mounted within combustion chamber 110, while another portion of conductive probe 202 including the first end 212 is held outside of combustion chamber 110.

In the exemplary embodiments of FIGS. 13 and 14, temperature control switch 204 is attached to conductive probe 202. Specifically, the first end 212 of conductive probe 202 is mounted on temperature control switch 204 (e.g., in contact therewith). One or more adhesives or mechanical connectors (e.g., screws, bolts, clamps, etc.) may secure conductive probe 202 to temperature control switch 204. During use, heat from the second end 214 of conductive probe 202 may thus be transmitted to temperature control switch 204 at the first end 212. Optionally, the mounted temperature detection assembly 200 may provide temperature control switch 204 at a fixed distance from chamber wall 138 and insulating grommet 232 (e.g., along the axial direction A). In other words, temperature control switch 204 may be spaced apart from the chamber wall 138 (e.g., at the outer surface 206). Moreover, temperature control switch 204 may be thermally insulated from chamber wall 138. Conductive probe 202 may define the fixed distance at which temperature control switch 204 is spaced from the outer surface 206 of chamber wall 138. In some such embodiments, a radial flange 216 of conductive probe 202 may engage insulating grommet 232 (e.g., at outer face 234), restricting axial movement of conductive probe 202 toward the combustion chamber 110. In the described position, conductive heat exchange between temperature control switch 204 and chamber wall 138, and thereby the effects the ambient environment, may thus be limited or restricted. Advantageously, the temperature detected at temperature control switch 204 may accurately reflect the temperature within combustion chamber 110, independent of the ambient conditions surrounding chamber wall 138.

Figure 17:
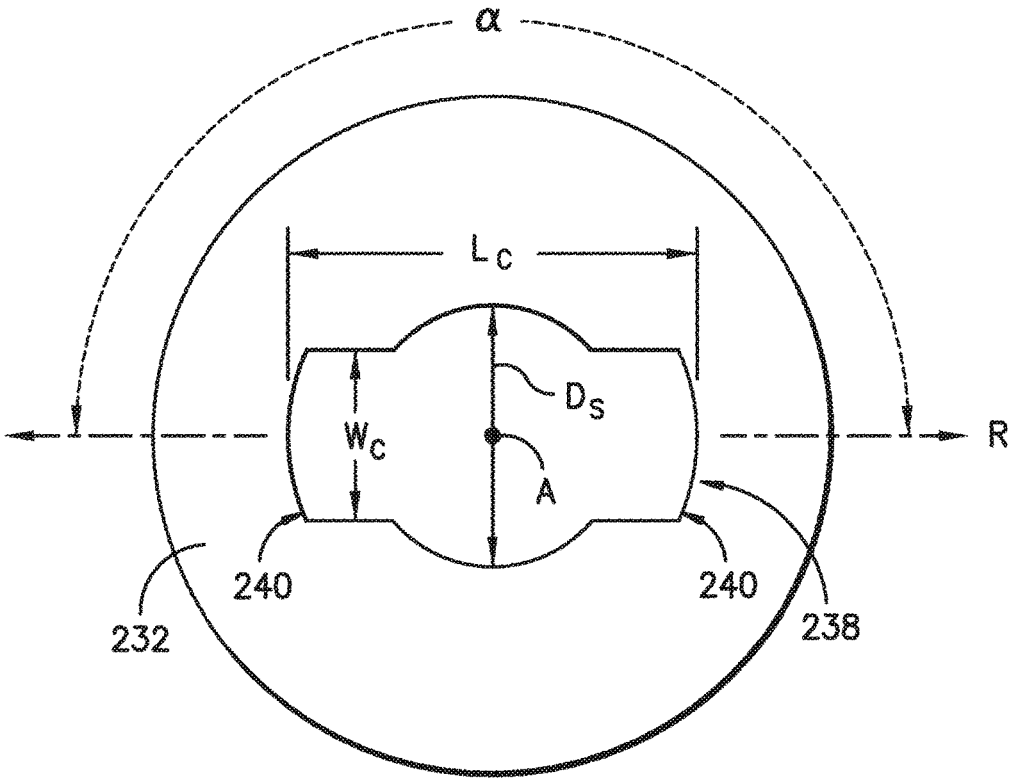
FIG. 17 provides a front view of the insulating grommet of exemplary embodiments of a water heater appliance, as shown in FIG. 12

Turning to FIGS. 13 and 17, views are provided of a portion of chamber wall 138 and a cross section of temperature detection assembly 200, respectively. As illustrated in FIG. 13, some embodiments of conductive probe 202 generally extend along the axial direction A between the first end 212 and the second end 214. Optionally, conductive probe 202 may be formed as an integral member (e.g., from a unitary and monolithic metal material). A probe body 218 may be formed at or from the second end 214 with a set (e.g., continuous) probe diameter $D_p$. A planar contact body 220 may be formed at or from the first end 212 to contact temperature control switch 204. Radial flange 216 may extend outward (e.g., along a radial direction R) from probe body 218 with a flange diameter $D_f$ that is greater than the probe diameter $D_p$. In some such embodiments, radial flange 216 is positioned between the first end 212 and the second end 214 (e.g., between planar contact body 220 and probe body 218 along the axial direction A). Optionally, a collar body 222 is provided between radial flange 216 and planar contact body 220.

Turning especially to FIG. 17, the grommet passage 238 defined through insulating grommet 232 may include multiple discrete lengths for a single continuous void (e.g., perpendicular to the axial direction A). For instance, a passage diameter $D_s$ may be included as a first maximum length of the grommet passage 238 (e.g., maximum length in a vertical direction V). In optional embodiments, one or more flared channels 240 may extend radially outward from the passage diameter $D_s$ as a continuous portion of grommet passage 238. A flared channel length $L_c$ outward from passage diameter $D_s$ may thus define a second maximum length that is greater than the first maximum length at an angle (e.g., 90°) offset from the first maximum length about the axial direction A. A flared channel width $W_c$ that is less than the passage diameter $D_s$ may be defined from the flared channel length $L_c$ (e.g., at a point that is radially spaced from the axial direction A). As shown, the passage diameter $D_s$ may thus be smaller than flared channel length $L_c$, while being larger than the flared channel width $W_c$. In additional or alternative embodiments, two discrete flared channels 240 are spaced apart about the axial direction A at a predetermined angle $\alpha$. For example, the predetermined angle $\alpha$ may be 180° such that the flared channel length $L_c$ extends from the radial maxima of one flared channel 240 to the radial maxima of the other flared channel 240.

In some embodiments, probe diameter $D_p$ (FIG. 15) is less than passage diameter $D_s$, such that probe body 218 (FIG. 15) may be readily received within grommet passage 238 between the first end 212 and the second end 214 of conductive probe 202 (FIG. 13). In further embodiments, probe diameter $D_p$ (FIG. 13) is greater than flared channel width $W_c$, such that probe body 218 may be prevented from passing into or through flared channel 240. In additional or alternative embodiments, flange diameter $D_f$ (FIG. 13) is greater than passage diameter $D_s$ and/or flared channel length $L_c$, thereby restricting radial flange 216 from passing into or through grommet passage 238.

Figure 15:
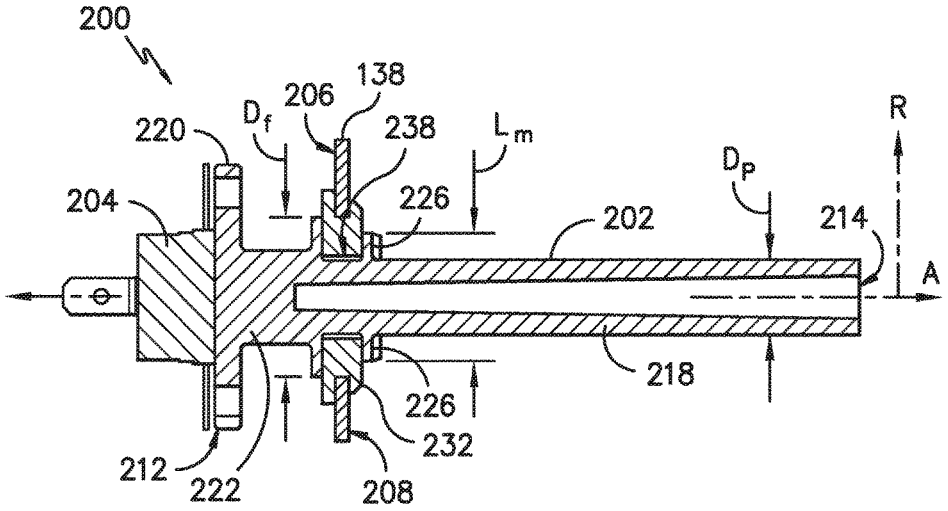
FIG. 15 provides a close-up, cross-sectional top view of the mounted temperature detection assembly and wall of FIG. 14.
Figure 16:
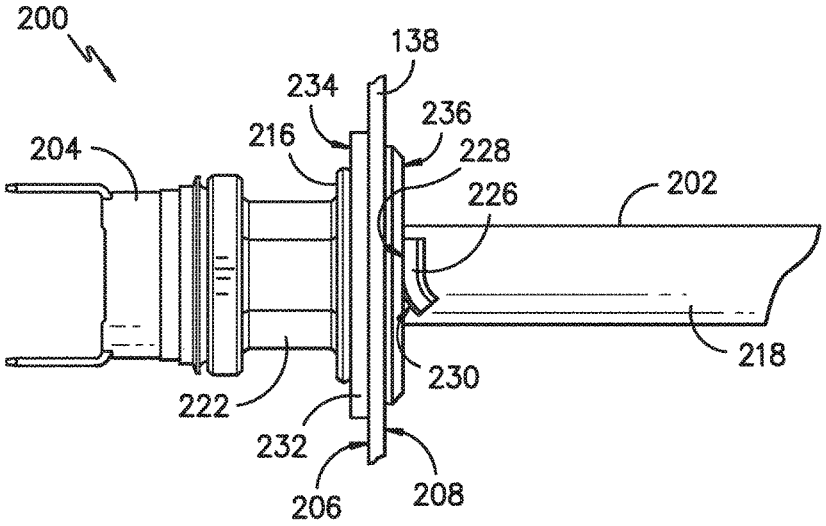
FIG. 16 provides a close-up, partial side view of the mounted temperature detection assembly and wall of FIG. 14.

Turning now to FIGS. 14 through 16, various views of the mounted temperature detection assembly 200, as illustrated in FIG. 6, are provided. In some embodiments, conductive probe 202 includes a plurality of radial tabs 226. For instance, a pair of radial tabs 226 may extend outward from probe body 218 in the radial direction R. The radial tabs 226 may generally correspond to the flared channels 240 (FIG. 17). In turn, each of the radial tabs 226 may be sized to slide or pass through a corresponding flared channel 240 along the axial direction A. For example, the radial tabs 226 may be angularly spaced or offset at the predetermined angle α. The combined length $L_m$ defined by the radial tabs 226 and probe body 218 may be less than the flared channel length $L_c$ (FIG. 17). Moreover the combined length $L_m$ may be greater than the passage diameter $D_s$ (FIG. 17).

In certain embodiments, each radial tab 226 defines a support surface 228 and an angled leading surface 230 extending continuously from support surface 228. As shown, when conductive probe 202 is mounted to chamber wall 138, both support surface 228 and angled leading surface 230 may be generally directed toward inner face 236 of insulating grommet 232. For instance, both support surface 228 and angled leading surface 230 extend along the radial direction R from probe body 218. In some such embodiments, support surface 228 may extend orthogonally to the axial direction A (e.g., along a plane orthogonal to the axial direction A). Leading surface 230 may extend arcuately or at a non-orthogonal angle from support surface 228 toward the second end 214 of conductive probe 202. In other words, an arcuate angle may be defined between leading surface 230 and a plane along which support surface 228 is defined. Support surface 228 may engage (e.g., contact) inner face 236 when mounted, while leading surface 230 is spaced apart from the inner face 236 (e.g., along the axial direction A). In specific embodiments, support surface 228 contacts inner face 236 in an interference fit such that insulating grommet 232 is held between radial flange 216 and support surface 228. Insulating grommet 232 may be further held in an interference fit within the grommet passage 238. In turn, axial movement of the conductive probe 202 may be restricted in the mounted position.

Thus, as illustrated by FIGS. 13 and 14, temperature detection assembly 200 may be rotated about the axial direction A such that radial tabs 226 and flared channels 240 are mutually aligned about axial direction A. While tabs 226 and channels 240 are mutually aligned, temperature detection assembly 200 may be moved along the axial direction A such that radial tabs 226 are positioned within the combustion chamber 110. Specifically, temperature detection assembly 200 may move along the axial direction toward combustion chamber 110 until radial flange 216 engages (e.g., contacts) the outer face 234 of insulating grommet 232. Subsequently, conductive probe 202 may be rotated about the axial direction A. As conductive probe 202 is rotated, leading surface 230 may slide along the inner face 236 of insulating grommet 232, further motivating conductive probe 202 along the axial direction A, until support surface 228 is brought into contact with inner face 236. Radial tabs 226 may thus hold temperature detection assembly 200 against insulating grommet 232 in a mounted position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas fueled water heater appliance, comprising:

a tank for storage of water for heating;

a chamber wall having an outer surface and an inner surface defining a combustion chamber, the chamber wall further defining a wall aperture extending from the outer surface to the inner surface;

a gas burner positioned adjacent to the tank and within the combustion chamber to heat the water in the tank;

a valve controlling a flow of gaseous fuel to the gas burner;

a temperature control switch in operable communication with the valve, the temperature control switch being spaced apart from the outer surface of the chamber wall along an axial direction outside of the combustion chamber; and a conductive probe extending through the wall aperture of the chamber wall along the axial direction from a first end positioned on the temperature control switch to a second end positioned within the combustion chamber, wherein the conductive probe comprises a probe body, a radial flange, a collar body, and a planar contact body, wherein the planar contact body extends along the axial direction from the temperature control switch at the first end to the collar body, wherein the collar body extends along the axial direction from the planar contact body to the radial flange at the outer surface of the chamber wall, wherein the probe body extends along the axial direction through the wall aperture from the radial flange to the second end, and wherein the collar body has an outer diameter that is smaller than an outer diameter of the planar contact body.

2. The gas fueled water heater appliance of claim 1, wherein the temperature control switch is a bimetal switch that is closed below a threshold temperature.

3. The gas fueled water heater appliance of claim 1, wherein the wall aperture has an aperture diameter, and wherein the radial flange has a flange diameter that is greater than the aperture diameter.

4. The gas fueled water heater appliance of claim 3, wherein the radial flange is engaged with an outer surface of the chamber wall.

5. The gas fueled water heater appliance of claim 4, wherein the conductive probe includes a plurality of radial tabs engaged with an inner surface of the chamber wall.

6. The gas fueled water heater appliance of claim 1, further comprising an insulating grommet received within the wall aperture defined through the chamber wall, the insulating grommet defining a grommet passage receiving the conductive probe.

7. The gas fueled water heater appliance of claim 6, wherein the grommet passage has a passage diameter, and wherein the radial flange has a flange diameter that is greater than the passage diameter.

8. The gas fueled water heater appliance of claim 7, wherein the radial flange is engaged with an outer face of the insulating grommet.

9. The gas fueled water heater appliance of claim 8, wherein the conductive probe includes a plurality of radial tabs engaged with an inner face of the insulating grommet.

10. A gas fueled water heater, comprising:

a tank for storage of water for heating;

a chamber wall defining a combustion chamber, the chamber wall comprising an inner surface directed toward the combustion chamber and an outer surface directed away from the combustion chamber, the chamber wall further defining a wall aperture extending from the outer surface to the inner surface;

a gas burner positioned adjacent to the tank and within the combustion chamber to heat the water in the tank;

a valve controlling a flow of gaseous fuel to the gas burner;

a temperature control switch in operable communication with the valve, the temperature control switch being spaced apart from the outer surface of the chamber wall along an axial direction outside of the combustion chamber; and a conductive probe extending through the wall aperture of the chamber wall along the axial direction from a first end to a second end, the first end being positioned proximal to the outer surface and disposed on the temperature control switch, the second end being positioned proximal to the inner surface and disposed within the combustion chamber, wherein the conductive probe comprises a plurality of radial tabs, a probe body, a radial flange, a collar body, and a planar contact body, wherein the planar contact body extends along the axial direction from the temperature control switch at the first end to the collar body, wherein the collar body extends along the axial direction from the planar contact body to the radial flange at the outer surface of the chamber wall, wherein the probe body extends along the axial direction through the wall aperture from the radial flange to the second end, wherein the plurality of radial tabs extend along a radial direction from the probe body within the combustion chamber to restrict movement of the conductive probe along the axial direction end, and wherein the collar body has an outer diameter that is smaller than an outer diameter of the planar contact body.

11. The gas fueled water heater appliance of claim 10, wherein the wall aperture extends from the outer surface to the inner surface along an aperture diameter, and wherein the radial flange has a flange diameter that is greater than the aperture diameter.

12. The gas fueled water heater appliance of claim 11, wherein the radial flange is engaged with the outer surface of the chamber wall.

13. The gas fueled water heater appliance of claim 12, wherein the radial tabs is engaged with the inner surface of the chamber wall.

14. The gas fueled water heater appliance of claim 10, further comprising an insulating grommet extending through the chamber wall, wherein the insulating grommet defines a grommet passage, and wherein the conductive probe is received within the grommet passage.

15. The gas fueled water heater appliance of claim 14, wherein the grommet passage has a passage diameter, and wherein the radial flange has a flange diameter that is greater than the passage diameter.

16. The gas fueled water heater appliance of claim 15, wherein the insulating grommet comprises an inner face directed toward the combustion chamber and an outer face directed away from the combustion chamber, and wherein the radial flange is engaged with the outer face of the insulating grommet.

17. The gas fueled water heater appliance of claim 16, wherein the plurality of radial tabs is engaged with the inner face of the insulating grommet.

18. The gas fueled water heater appliance of claim 10, wherein the temperature control switch is a bimetal switch that is closed below a threshold temperature.

19. A gas fueled water heater, comprising:

a tank for storage of water for heating;

a chamber wall defining a combustion chamber, the chamber wall comprising an inner surface directed toward the combustion chamber and an outer surface directed away from the combustion chamber, the chamber wall further defining a wall aperture extending from the outer surface to the inner surface;

a gas burner positioned adjacent to the tank and within the combustion chamber to heat the water in the tank;

a valve controlling a flow of gaseous fuel to the gas burner;

a temperature control switch in operable communication with the valve, the temperature control switch being spaced apart from the outer surface of the chamber wall along an axial direction outside of the combustion chamber; and a conductive probe extending through the wall aperture of the chamber wall along the axial direction from a first end to a second end, the first end being positioned proximal to the outer surface on the temperature control switch, the second end being positioned proximal to the inner surface within the combustion chamber, wherein the conductive probe comprises a plurality of radial tabs, a probe body, a radial flange, a collar body, and a planar contact body, wherein the planar contact body extends along the axial direction from the temperature control switch at the first end to the collar body, wherein the collar body extends along the axial direction from the planar contact body to the radial flange at the outer surface of the chamber wall, wherein the probe body extends along the axial direction through the wall aperture from the radial flange to the second end, wherein the plurality of radial tabs extend along a radial direction from the probe body within the combustion chamber to restrict movement of the conductive probe along the axial direction, wherein each radial tab defines a support surface and an angled leading surface that extends at a non-orthogonal angle from the support surface, and wherein the collar body has an outer diameter that is smaller than an outer diameter of the planar contact body.

* * * * *